US006701678B1

(12) United States Patent
Skov et al.

(10) Patent No.: US 6,701,678 B1
(45) Date of Patent: Mar. 9, 2004

(54) MODULAR STORAGE ENCLOSURE

(75) Inventors: Erik L. Skov, Akron, OH (US); William F. Croft, Wooster, OH (US); Timothy M. Pierzynski, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 09/860,381

(22) Filed: May 18, 2001

(51) Int. Cl.[7] ..... E04H 1/00; E04H 14/00; E04H 3/00; E04H 5/00; E04H 6/00; E04H 9/00

(52) U.S. Cl. ..... 52/79.9; 52/586.1; 52/586.2; 52/589.1; 52/590.2; 52/591.1; 403/326; 403/329

(58) Field of Search ..... 52/79.1, 79.9, 52/583.1, 586.1, 586.2, 589.1, 590.1, 590.2, 590.3, 591.1, 591.2, 36.4, 36.6; 403/326, 329

(56) References Cited

U.S. PATENT DOCUMENTS

| | | | | |
|---|---|---|---|---|
| 603,147 | A | 4/1898 | Lordly | 189/36 |
| 2,079,635 | A | 5/1937 | Sharp | 189/34 |
| 2,270,161 | A | 1/1942 | Briggs | 189/2 |
| 2,981,383 | A | 4/1961 | Dunn | 189/36 |
| 3,070,646 | A | 12/1962 | Lindgren | 174/35 |
| 3,381,430 | A | 5/1968 | Wiczer | 52/282 |
| 3,436,881 | A | 4/1969 | Schlecht | 52/90 |
| 3,452,501 | A | 7/1969 | Zimmer et al. | 52/625 |
| 3,513,608 | A | 5/1970 | Nagrod | 52/82 |
| 3,516,216 | A | 6/1970 | Galloway | 52/731 |
| 3,543,456 | A | 12/1970 | Georgoire | 52/72 |
| 3,638,385 | A | 2/1972 | Nobels et al. | 52/665 |
| 3,640,039 | A | 2/1972 | McKee et al. | 52/281 |
| 3,675,380 | A | 7/1972 | Moss | 52/80 |
| 3,820,299 | A | 6/1974 | Verholt | 52/753 |

(List continued on next page.)

FOREIGN PATENT DOCUMENTS

| | | | | |
|---|---|---|---|---|
| CH | 396 368 | | 1/1966 | |
| DE | 26 43 270 | A1 | 3/1978 | |
| DE | 34 18687 | A1 | 11/1985 | |
| DE | 8913507.5 | | 3/1990 | |
| DE | 3843151 | * | 7/1990 | E02D/29/12 |
| EP | 0359309 | A3 | 3/1990 | |
| FR | 1.028.791 | | 5/1953 | |
| FR | 1.311.988 | | 11/1962 | |
| FR | 1.447.663 | | 6/1966 | |
| GB | 1.081.423 | | 8/1967 | |
| GB | 1 2623 95 | | 2/1972 | |
| GB | 2115452 | A | 9/1983 | |
| GB | 2 176 514 | A | 1/1986 | |
| GB | 2281326 | A | 3/1995 | |
| IE | 22203 | | 7/1959 | |
| JP | 4-238954 | * | 1/1991 | E04B/5/54 |

OTHER PUBLICATIONS

International Search Report for PCT/US02/15630 dated Sep. 20, 2002.

"item Industrietechnik" promotional materials, bearing a designation 0.4.106.31 05/95 (13 pages).

International Preliminary Examination Report issued in PCT/US02/15630, dated Jul. 8, 2003 (with copy of examined claims).

*Primary Examiner*—Carl D. Friedman
*Assistant Examiner*—Chi Q Nguyen
(74) *Attorney, Agent, or Firm*—Marshall, Gerstein & Borun LLP

(57) ABSTRACT

A storage enclosure including a plurality of panels defines an interior space. At least one of the plurality of panels includes a mounting interface configured to couple an accessory to one of the plurality of panels, and a panel interface configured to couple adjacent panels.

27 Claims, 11 Drawing Sheets

U.S. PATENT DOCUMENTS 3,854,269 A 12/1974 Hancock ..... 52/754
3,866,381 A 2/1975 Eschbach et al. ..... 52/731
3,992,839 A 11/1976 La Borde ..... 52/275
4,258,519 A 3/1981 Hugens ..... 52/282
4,294,051 A 10/1981 Hughes, Jr. ..... 52/228
4,447,099 A 5/1984 French et al. ..... 312/257
4,557,091 A 12/1985 Auer ..... 52/282
4,652,170 A 3/1987 Lew ..... 403/381
4,805,365 A 2/1989 Bastian ..... 52/282
5,036,634 A 8/1991 Lessard et al. ..... 52/79.1
5,155,961 A 10/1992 Bardo ..... 52/646
5,184,436 A * 2/1993 Sadler ..... 52/79.1
5,221,131 A * 6/1993 Lesperance et al. ..... 312/263
5,331,778 A 7/1994 Mazpule et al. ..... 52/79.5
5,372,415 A * 12/1994 Tisbo et al. ..... 312/108
5,386,788 A * 2/1995 Linker et al. ..... 109/58
5,398,909 A 3/1995 Sandwith ..... 249/207
5,413,236 A * 5/1995 Kenevan ..... 220/4.28
5,466,058 A * 11/1995 Chan ..... 312/111
5,529,423 A 6/1996 Burke et al. ..... 403/218
5,575,119 A 11/1996 Wolfowitz ..... 52/79.1
5,592,794 A 1/1997 Tundaun ..... 52/220.7
5,605,344 A * 2/1997 Insalaco et al. ..... 280/47.34
5,622,010 A * 4/1997 Weber ..... 52/36.1
5,647,181 A 7/1997 Hunts ..... 52/282.1
5,664,380 A 9/1997 Hsueh ..... 52/126.4
5,673,531 A 10/1997 Carcedo et al. ..... 52/656.9
5,724,774 A * 3/1998 Rooney ..... 52/79.5
5,775,046 A * 7/1998 Fanger et al. ..... 52/590.1
5,813,738 A 9/1998 Cheng ..... 312/263
5,864,997 A 2/1999 Kelly ..... 52/282.2
5,975,660 A * 11/1999 Tisbo et al. ..... 312/263
D420,838 S * 2/2000 Riga ..... 248/235
6,047,663 A * 4/2000 Moreau et al. ..... 119/529
6,053,591 A 4/2000 Kasanic ..... 312/297
6,099,092 A * 8/2000 Uffner et al. ..... 312/108
6,105,794 A 8/2000 Bauer ..... 211/94.01
6,113,203 A * 9/2000 Chen ..... 312/258
6,185,878 B1 2/2001 Bullard, III et al. ..... 52/79.5
6,202,867 B1 * 3/2001 Di Blasi et al. ..... 211/188
6,250,022 B1 * 6/2001 Paz et al. ..... 52/79.5
6,357,194 B1 * 3/2002 Jones, Jr. ..... 52/590.1

* cited by examiner

MODULAR STORAGE ENCLOSURE

FIELD OF THE INVENTION

The present invention relates to a storage enclosure, and more particularly to a modular storage enclosure.

BACKGROUND OF THE INVENTION

Storage enclosures such as sheds typically include a set of walls, a door, a floor, and a roof. The walls, roof, or floor may be formed by assembly and attachment of a plurality of separate panels using fasteners such as screws, bolts, nails, and pins. Additionally, such storage enclosures are generally used for storing items such as lawn care tools and equipment, recreational equipment, athletic equipment, and the like. Storage of such items within known storage enclosures may include installation of organizational devices (e.g., shelves, boxes, bins, and the like) that are free-standing or fastened to a wall. Hooks, tool hangers and other accessories that assist in storing of items may be fastened to the walls using fasteners such as screws, bolts, nails, staples, or the like.

Known storage enclosures have several disadvantages. For example, many known storage enclosures require a substantial amount of time, labor, planning, and skill to install, configure and reconfigure (if reconfigurable at all). Assembly or installation of organizational devices is inefficient due to a large number of necessary structural components and fasteners and incompatibility of different products from different manufacturers. Also, fasteners used to attach organizational devices to the walls of the storage enclosure may be invasive or destructive to the walls. Additionally, known methods of coupling adjacent panels to form walls or the roof are also destructive or invasive to the components themselves, making the sheds difficult to modify or rearrange. Such problems may discourage use, reconfiguration, and reorganization of the sheds and associated organizational devices.

To provide an inexpensive, reliable, and widely adaptable technique of securing organizational devices or other accessories to a wall of a storage shed, or to couple adjacent wall panels, that avoids the above-referenced and other problems, would represent a significant advance in the art.

SUMMARY OF THE INVENTION

A primary feature of the present invention is to provide an inexpensive, easy-to-manufacture, and aesthetically pleasing storage enclosure that overcomes the above-noted disadvantages.

Another feature of the present invention is to provide attachment interfaces for a wide variety of modular organizational devices or other accessories that reduce manufacturing assembly costs in many applications, and that are quickly and easily reconfigurable.

Another feature of the present invention is to provide structural components for a storage enclosure (such as walls, roof, etc.) that are relatively quickly and easily assembled and disassembled, configured or reconfigured, and the like.

Another feature of the present invention is to provide a storage enclosure that is lightweight and yet provides suitable strength and rigidity as a storage enclosure or as a display panel.

How these and other advantages and features of the present invention is accomplished, individually, collectively, or in various subcombinations, will be described in the following detailed description of the preferred and other exemplary embodiments, taken in conjunction with the FIGURES. Generally, however, they may be accomplished in a storage enclosure including a plurality of panels defining an interior space. At least one of the plurality of panels includes a mounting interface configured to couple an accessory to one of the plurality of panels, and a panel interface configured to couple adjacent panels.

These and other advantages and features of the present invention may also be accomplished in a storage enclosure including a plurality of panels defining an interior space. At least one of the plurality of panels includes a mounting interface configured to couple an accessory to one of the plurality of panels. The mounting interface includes a flange that defines a receptacle.

These and other advantages and features of the present invention may further be accomplished in a panel including a mounting interface configured to couple an accessory to the panel. The mounting interface includes a flange which defines a retaining profile.

The disclosed embodiments further relate to various features and combinations of features shown and described in the disclosed embodiments. Other ways in which the objects and features of the present invention is accomplished will be described in the following specification or will become apparent to those skilled in the art after they have read this specification. Such other ways are deemed to fall within the scope of the disclosed embodiments if they fall within the scope of the claims which follow.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, the exemplary embodiments described herein are configured to provide an inexpensive and efficient enclosure for manufacturing, shipping, storing, displaying, assembling, reconfiguring and modifying a modular storage enclosure. The modular storage enclosure may be sold as a kit or the individual structural components may be sold separately (i.e., "a la carte") so that the consumer may purchase the appropriate components according to his or her desired dimensional and accessory configuration, for repair or replacement, or for reconfiguration of an existing storage enclosure.

Second, while the components of the disclosed embodiments will be illustrated as a shed, the features of the disclosed embodiments have a much wider applicability. For example, the accessory mounting interface design can be used for other storage devices, units, enclosures, boxes, bins, storage containers, display panels or boards, vehicle storage containers, totes for storing camping or other outdoor recreation gear, and other office or home organization and storage products. Also, the connectors can be used for any of a variety of containers that are made from a variety of materials such as plastics, wood, metal, or metal alloys. Further, the size of the various components and the size of the enclosures can be widely varied.

Third, the particular materials used to construct the exemplary embodiments are also illustrative. For example, blow molded high density polyethylene is the preferred material and method for making the panels, roof, and doors, but other materials can be used, including other thermoplastic resins such as structural foam polypropylene, polypropylene, acrylonitrile butadiene styrene ("ABS"), polyurethane nylon, any of a variety of homopolymer plastics, copolymer plastics, plastics with special additives, filled plastics, etc. Also, other molding operations may be used to form these components, such as injection molding, rotational molding, etc. Also, injection molded high density polyethylene is the preferred material and method for making the connectors, but other materials can be used, including other thermoplastic resins such as polypropylene, polyethylene, acrylonitrile butadiene styrene ("ABS"), polyurethane nylon, any of a variety of homopolymer plastics, copolymer plastics, plastics with special additives, filled plastics, etc. Also, other molding operations may be used to form these components. Alternatively, the panels and/or connectors may be made from other materials including metal, wood, and the like. Also, the panels and/or connectors may be from a variety of manufacturing techniques such as stamping of sheets, casting, machining, and the like.

Figure 1:
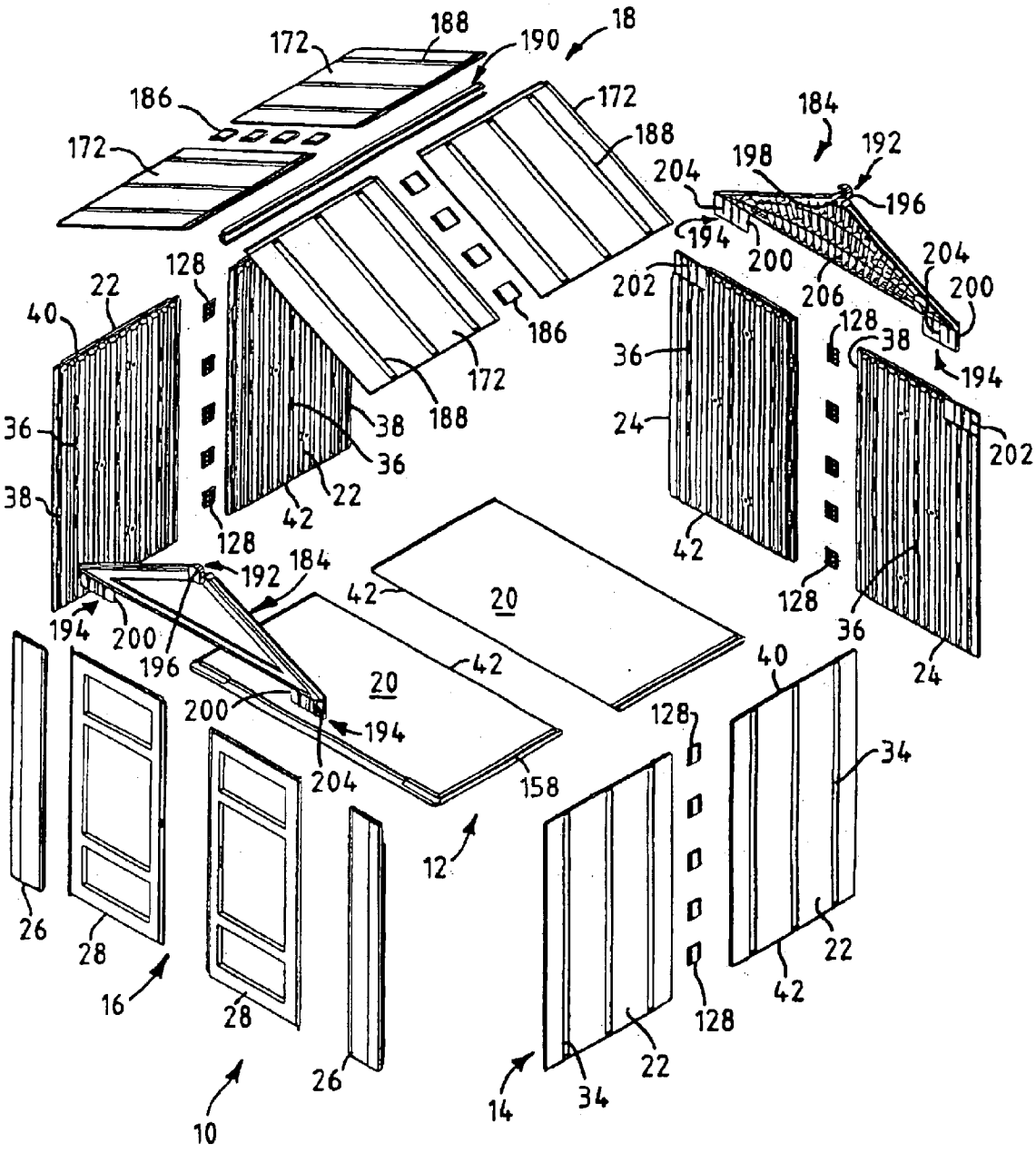
FIG. 1 is an exploded perspective view of a modular storage enclosure according to an exemplary embodiment.

Proceeding now to descriptions of the preferred and exemplary embodiments, FIG. 1 is an exploded perspective view of a storage enclosure 10 according to an exemplary embodiment. Storage enclosure 10 is shown as a modular structure that includes a floor assembly 12, a wall assembly 14, a door assembly 16, and a roof assembly 18. Floor assembly 12 forms a perimeter or a footprint for storage enclosure 10, and includes a plurality of floor panels 20. According to a preferred embodiment, floor panels 20 are coupled by interlocking teeth which provide a snap-fit engagement when assembled. According to an alternative embodiment, floor panels 20 include interfaces that are coupled together using any of a variety of fasteners.

Wall assembly 14 includes a plurality of panels (shown as side panels 22, rear panels 24, front panels 26, and door panels 28) coupled to floor assembly 12 and roof assembly 18. Each of the panels include an exterior face 30 and an interior face 32. According to a preferred embodiment, exterior face 30 of the panels include channels 34 that are configured to provide an ornamental appearance, drainage properties, and additional rigidity. Alternatively, exterior face 30 of the panels may be generally flat or have any of a variety of cosmetic and/or functional textures or configurations.

Each of the panels also include a plurality of multi-functional mounting interfaces 36, a plurality of panel or connector interfaces 38, a plurality of roof interfaces 40, and a plurality of floor interfaces 42. According to a preferred embodiment, mounting interfaces 36, connector interfaces 38, roof interfaces 40, and/or floor interfaces 42 are integrally formed with the panel (e.g., as a single, one piece molded article).

Figure 3:
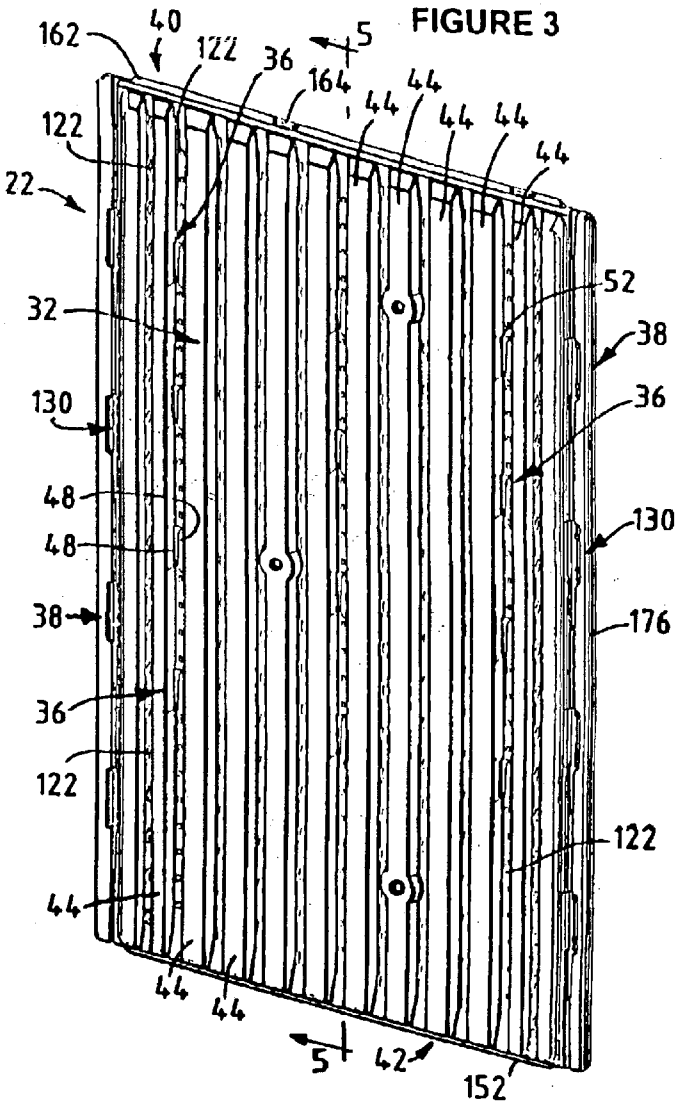
FIG. 3 is a perspective view of an interior surface of the panel of FIG. 2.
Figure 2:
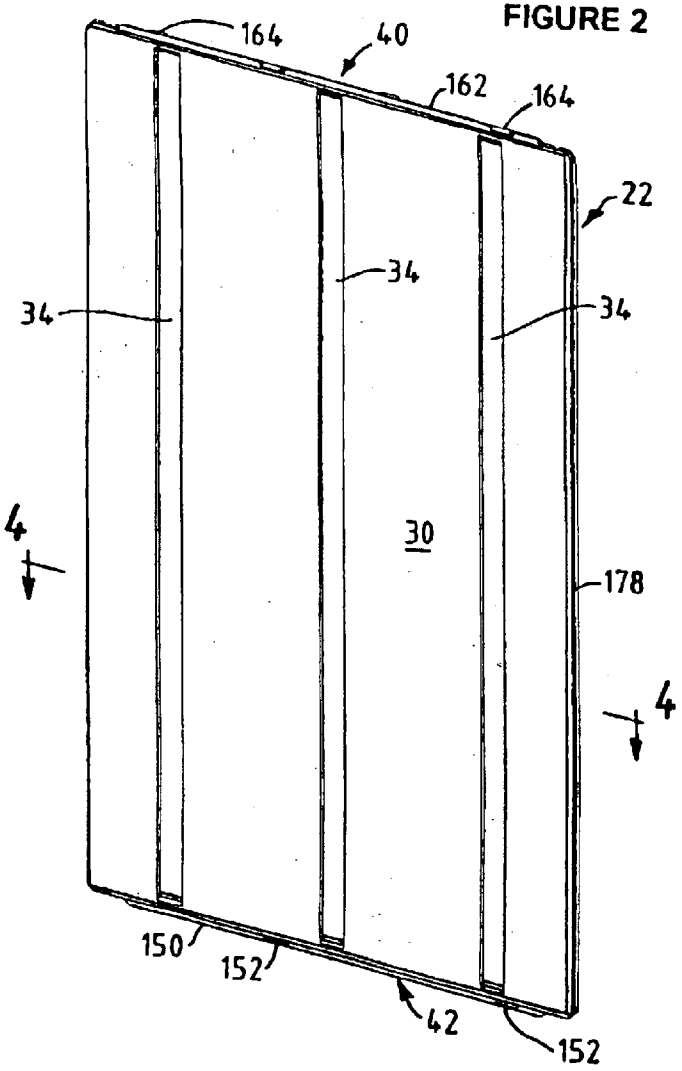
FIG. 2 is perspective view of an exterior surface of a panel for the modular storage enclosure of FIG. 1.
Figure 4:
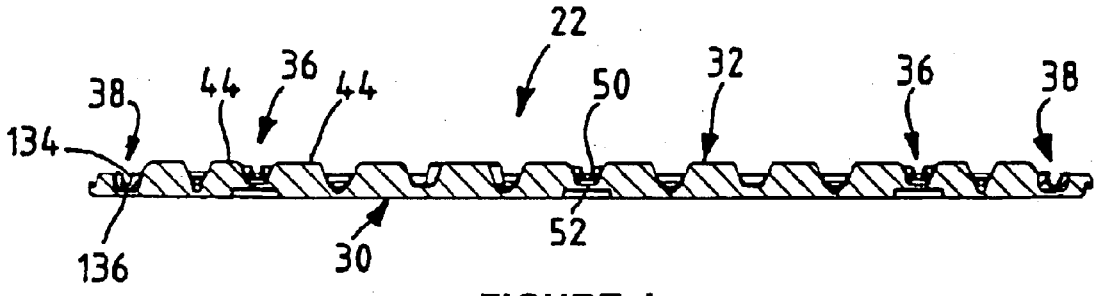
FIG. 4 is a sectional view of the panel of FIG. 2 taken along line 4—4.
Figure 5:
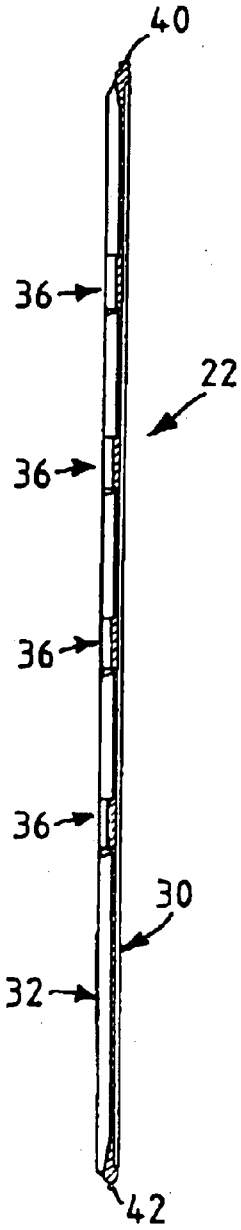
FIG. 5 is a sectional view of the panel of FIG. 3 taken along line 5—5.
Figure 6:
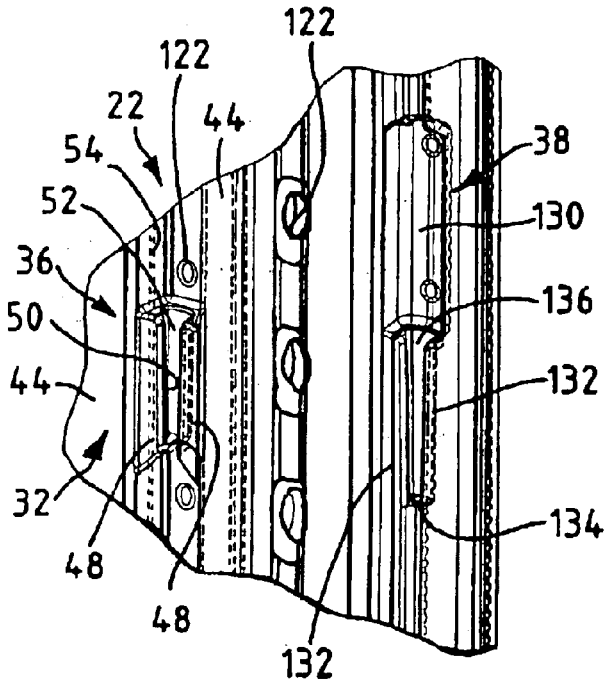
FIG. 6 is a fragmentary perspective view of the panel of FIG. 3.
Figure 7:
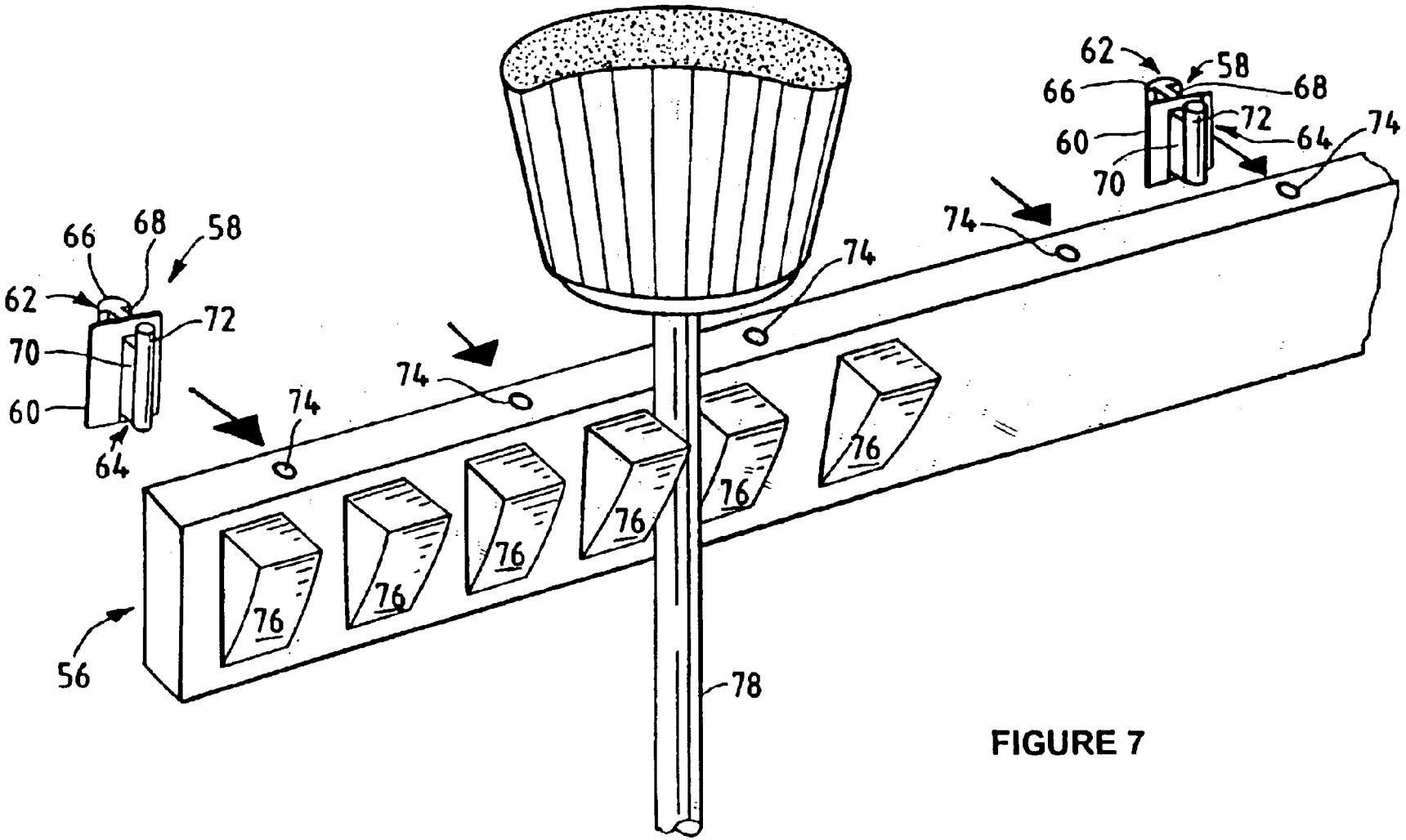
FIG. 7 is an exploded schematic perspective view of an accessory and mounting brackets according to an exemplary embodiment.

Referring to FIGS. 3 and 6, mounting interfaces 36 are disposed between a plurality of ribs 44, and are configured to provide a retaining profile for coupling any of a variety of items (e.g., accessories such as tools), structural reinforcement, shelving, work surfaces, and the like. According to a preferred embodiment, mounting interface 36 is located on interior face 32 of the panel. Alternatively, mounting interface 36 may be located on exterior surface 30 of the panel (e.g., so that accessories may be attached to the exterior of enclosure 10).

According to an exemplary embodiment, mounting interface 36 includes a pair of opposing flanges 48 that define a slot 50 and a pocket or receptacle 52. According to a preferred embodiment, flanges 48 are configured to provide a "dovetail" cross section so that an accessory may be inserted and slid into a secure engagement with the panel. Flanges 48 extend from sidewalls 54 of ribs 44 such that slot 50 has a varying width (e.g., slot 50 is tapered such that wider nearest its top portion than at its bottom portion). According to an alternative embodiment, multi-functional mounting interface 36 may be provided by any of a variety of shapes or configurations of retaining profiles configured to capture the accessory.

Referring to FIGS. 7–10, accessories are configured to be coupled to one or more of the panels to provide a variety of modular functionality, including support or organizational structures (such as shelving, hooks, etc.), work surfaces (such as desks, workbenches, countertops, etc.), containers, and the like. According to a preferred embodiment shown in FIG. 7, the accessory (shown as a rack 56) is mounted to the panel with a mounting bracket 58. Mounting bracket 58 includes a base 60, a projection 62 extending from base 60, and an accessory interface 64. Projection 62 is configured to engage mounting interface 36 and includes a head 66 connected to base 60 by a stem 68 which has a smaller cross-sectional dimension than head 66. Preferably, slot 50 has a tapered width wherein the wider end is nearest recess 46. Also preferably, head 66 and stem 68 are shaped to provide a snug fit with receptacle 52 and slot 50, respectively. Mounting bracket 58 engages mounting interface 36 by positioning projection 62 between ribs 44 and sliding mounting bracket 58 downward so that head 66 is disposed in receptacle 52 and stem extends through slot 50.

Accessory interface 64 is also configured to engage rack 56. Accessory interface 64 includes a base 70 and a projection 72. Base 70 is configured to provide a support surface for the accessory. Projection 72 is configured to engage the accessory by extending through an aperture 74 in rack 56. Rack 56 includes a plurality of spaced apart support members 76 configured to support one or more items (e.g., stick goods such as a broom 78, a work surface (not shown), tools, lawn care equipment, cleaning implements, etc.). Alternatively, accessory interface 64 may be used to couple any of a variety of storage devices or accessories to the panels.

Figure 9:
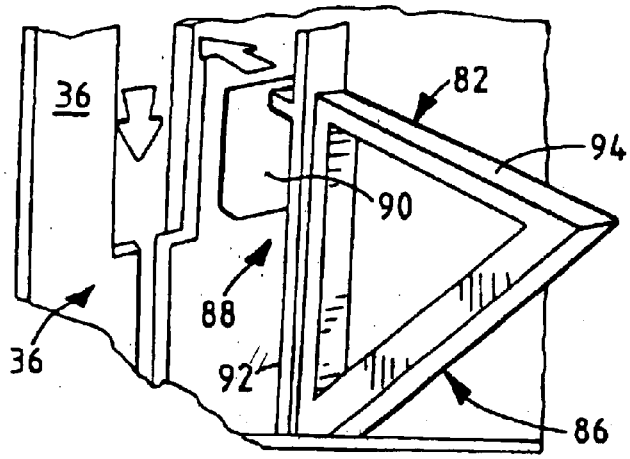
FIG. 9 is an exploded perspective view of a mounting bracket of FIG. 8.
Figure 8:
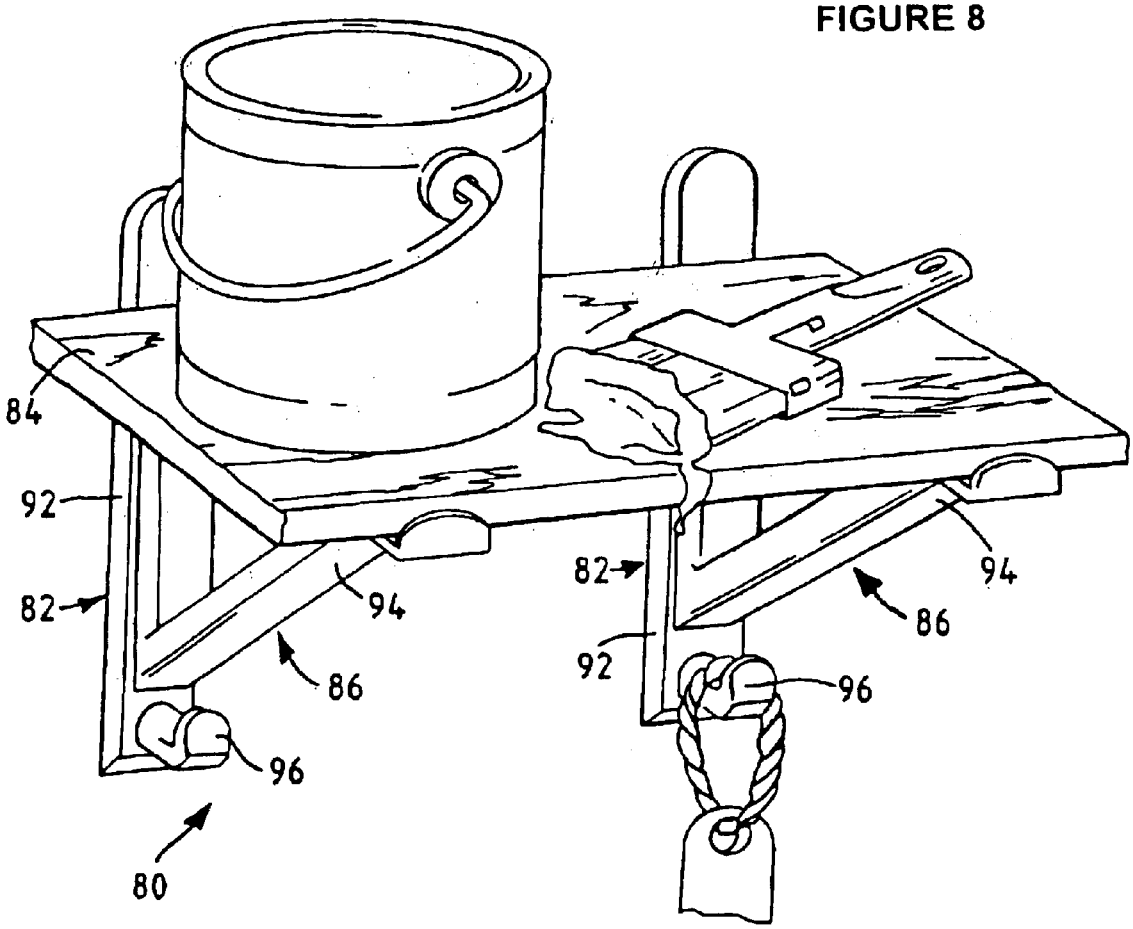
FIG. 8 is a perspective view of an accessory with mounting brackets according to an exemplary embodiment.

Referring to FIGS. 8 and 9, the accessory is shown as a shelf assembly 80. Shelf assembly 80 includes a mounting bracket 82 and a panel 84 supported by mounting bracket 82. Mounting bracket 82 includes a frame 86 and a projection (shown as a hook 88) extending from frame 86. Hook 88 includes a downward portion 90 configured to engage mounting interface 36. According to a preferred embodiment, hook 88 is a flat member that is inserted into recess 46 and lowered so that downward portion 90 is disposed in receptacle 52 and held in place by flanges 48. Frame 86 includes a base member 92 and a shelf support member 94. Base member 92 and/or shelf support member 94 may include a projection 96 for supporting or suspending one or more items.

Figure 10:
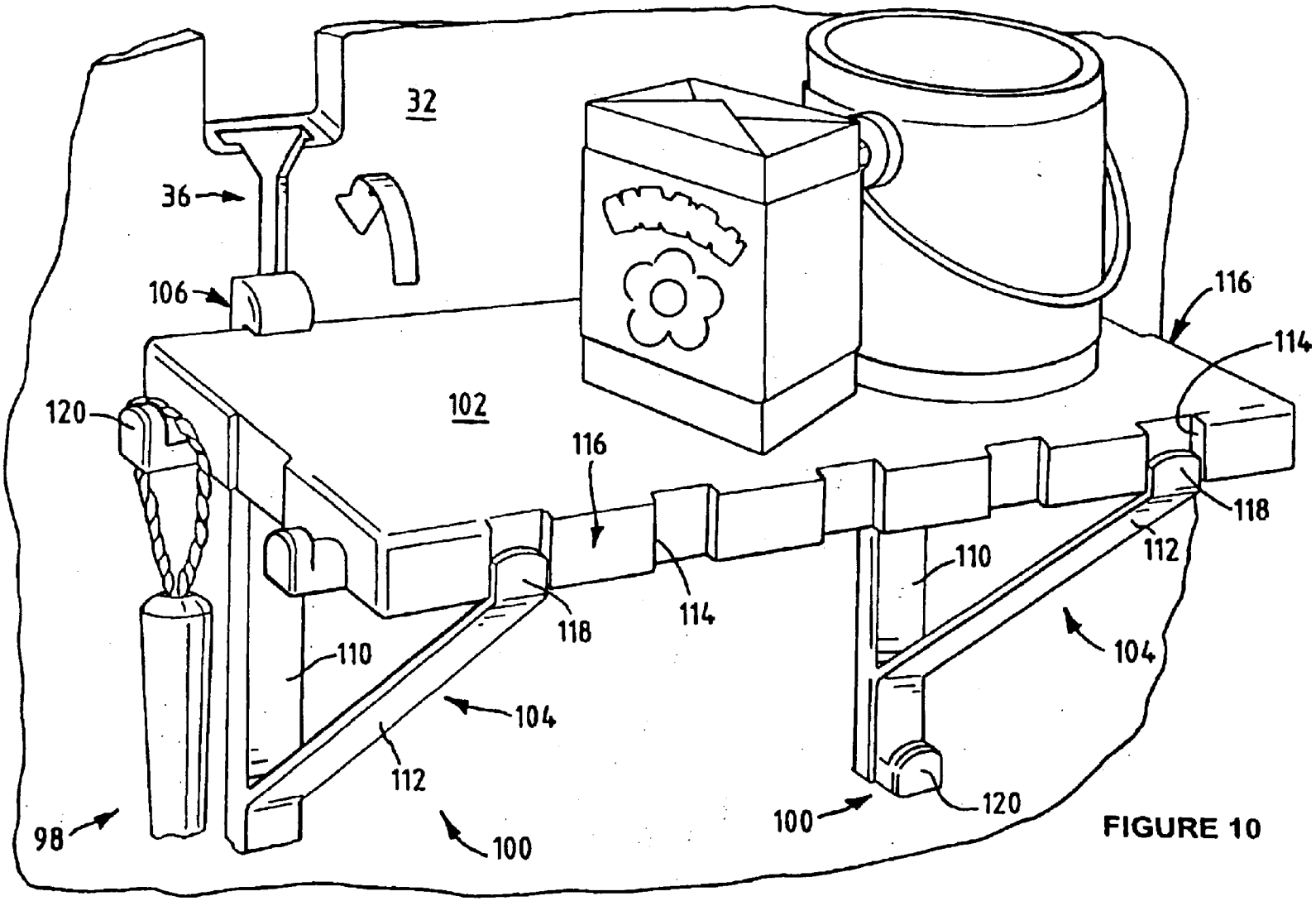
FIG. 10 is an exploded perspective view of an accessory according to an exemplary embodiment.
Figure 11:
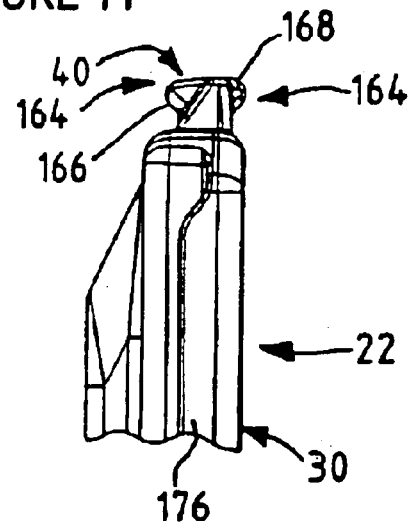
FIG. 11 is a fragmentary side elevation view of the panel of FIG. 3.
Figure 12:
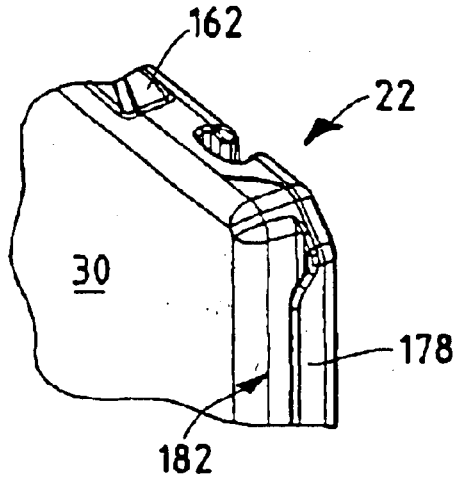
FIG. 12 is a fragmentary perspective view of the panel of FIG. 2.
Figure 13:
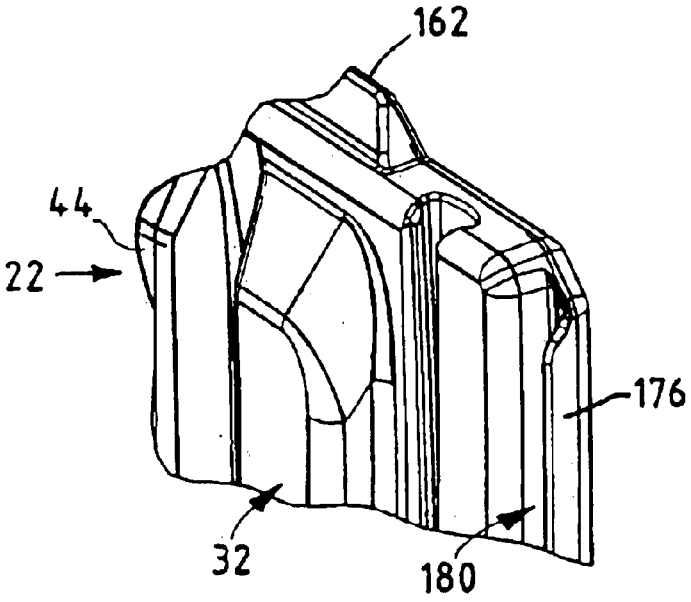
FIG. 13 is a fragmentary perspective of the panel of FIG. 3.
Figure 21:
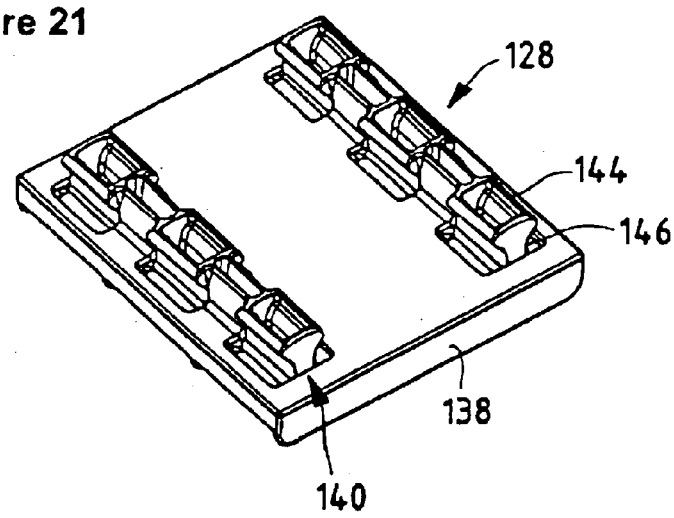
FIG. 21 is a perspective view of a connector according to a preferred embodiment.
Figure 22:
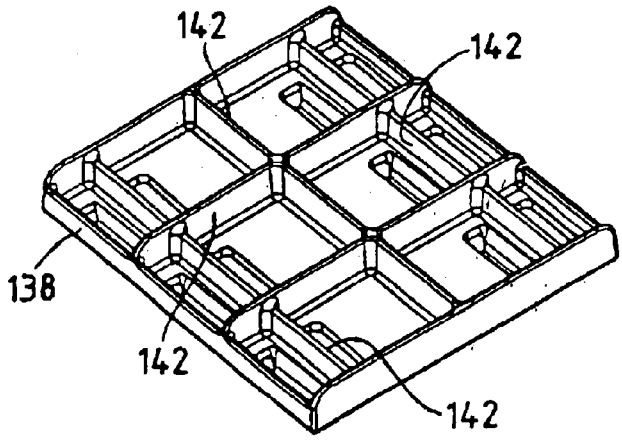
FIG. 22 is a perspective view of the connector of FIG. 21.

Referring to FIG. 10, the accessory is shown as a shelf assembly 98 according to an alternative embodiment. Shelf assembly 98 includes a mounting bracket 100 and a panel 102 supported by mounting bracket 100. Mounting bracket 100 includes a frame 104 and a projection 106 extending from frame 104. Projection 106 is configured similarly to projection 96 shown in FIG. 7 or projections 108 shown in FIG. 21. Projection 106 includes a head and stem configured to engage flanges 48 of mounting interface 36. Frame 104 includes a base member 110, a shelf support member, and a brace member 112. According to a preferred embodiment, panel 102 includes a plurality of vertical grooves 114 along edges 116 that are configured to receive ends 118 of brace member 112. As such, panel 102 may be supported by a selectable number of mounting brackets 100, depending on expected load forces, desired strength, panel configuration (e.g., some panels may have more or fewer spaced apart mounting interfaces 36), and the like. Panel 102 and/or mounting bracket 100 may also include one or more hooks 120.

Also disposed between ribs 44 are a plurality of recesses 122 (also known as "tack-offs"), which are compression points wherein an interior face 32 contacts or joins to an exterior face 30. According to a preferred embodiment, interior face 32 and exterior face 30 contact during the blow molding operation and solidify together to provide rigidity and strength to the panel, and to prevent interior and exterior faces 32, 30 from sliding with respect to one another.

Figure 23:
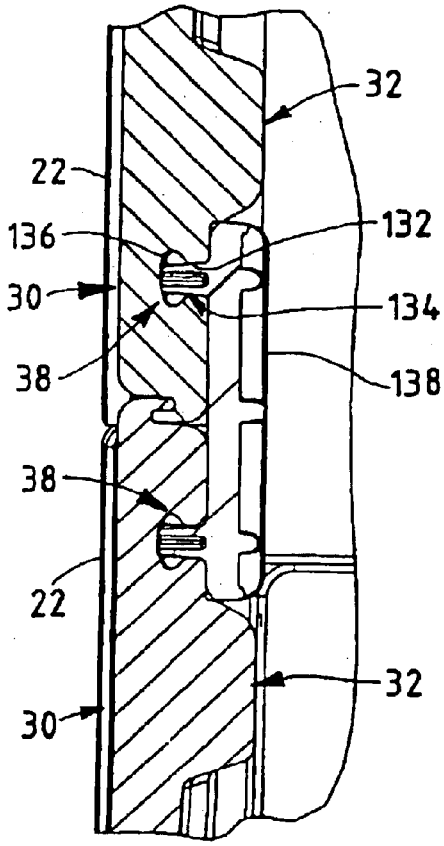
FIG. 23 is a fragmentary sectional view of the connector and panels.

Referring to FIGS. 3, 6, and 23, connector interface 38 is configured to provide a retaining profile for receiving a connector 128 that couples adjacent panels (e.g., adjacent rear panels 24, adjacent side panels 22, etc.). According to a preferred embodiment, connector interface 38 is located on interior face 32 of the panel. Alternatively, connector interface 38 may be located on exterior face 30.

Connector interface 38 includes a recess 130 and a pair of flanges 132 that define a slot 134 and a receptacle 136. Recess 130 is disposed above opening of flanges 132 and is configured to provide an area to align and receive connector 128. According to a preferred embodiment, connector interface 38 is a "dovetail" cavity.

Referring to FIGS. 1, 3, 6, and 20–23, connector 128 includes a base 138 and one or more projections 140 extending from base 138. Base 138 may have any of a variety of shapes and configurations and may include one or more reinforcement ribs 142 configured to provide additional strength and rigidity to connector 128. Projections 140 are configured to engage flanges 132 in connector interface 38 on the panels. According to a preferred embodiment, projections 140 include a head 144 and a stem 146 which has a smaller cross sectional dimension than head 144 (e.g., "T"-shaped, or the like). Connector 128 engages connector interfaces 38 by inserting projection 140 into recess 130 and sliding connector 128 downward so that head 144 is disposed in receptacle 136 and stem 146 extends through slot 134 when connector 128 is engaged with a panel. Alternatively, projections 140 provide any of a variety of peripheral cross-sectional shapes that coincides with the shape of receptacle 136 of the retaining profile to provide a snug or secure engagement between connector interface 38 and side panel 22.

Referring to FIGS. 1–3, 5, 16, 19, and 20, side panels 22, rear panels 24, and front panels 26, each include floor interface 42 configured to couple the panels to floor assembly 12. Floor interface 42 includes a fin or flange 150 that extends below each of the panels and includes one or more detents 152. Detents 152 include a catch surface 154 extending generally perpendicular to flange 150 and a ramped surface 156. Ramped surface 156 of flange 150 is inserted into slots or apertures 158 in floor panels 20 so that catch surface 154 engages a bottom surface 160 (e.g., in a snap-fit arrangement). Preferably, detents 152 are configured to allow removal from apertures 158 in floor panels 20 (e.g., for disassemblying, reconfiguration, etc.)

Referring to FIGS. 1–3, 5, 11, 14, and 15, side panels 22 each include roof interface 40 configured to couple side panels 22 to roof assembly 18. Roof interface 40 includes a fin or flange 162 that extends above each of side panels 22 and include one or more detents 164. Detents 164 include a catch surface 166 extending generally perpendicular to flange 162, and a ramped surface 168. Ramped surface 168 of flange 162 is inserted into slots or apertures 170 in roof panels 172 so that catch surface 166 engages a bottom surface 174 (e.g., in a snap-fit arrangement). Preferably, detents 164 are configured to allow removal from apertures 170 in roof panels 172 (e.g., for disassemblying, reconfiguration, etc.)

Figure 14:
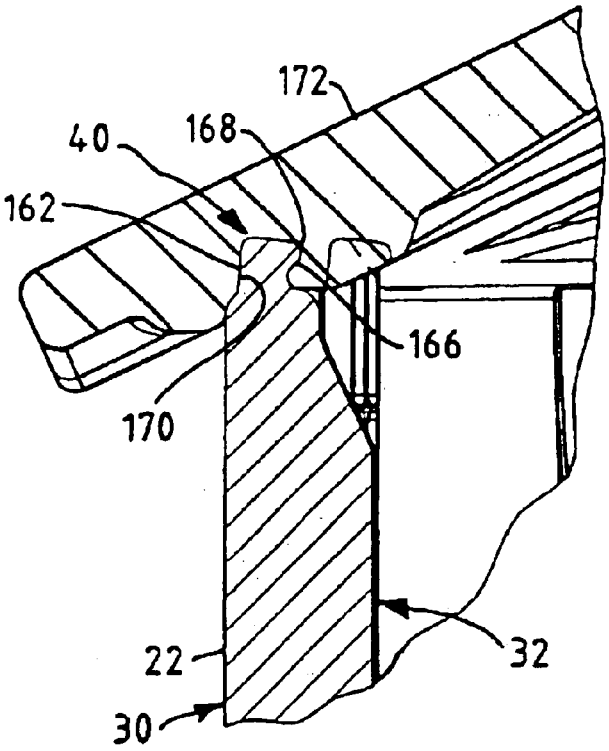
FIG. 14 is a fragmentary sectional view of the modular storage enclosure.
Figure 15:
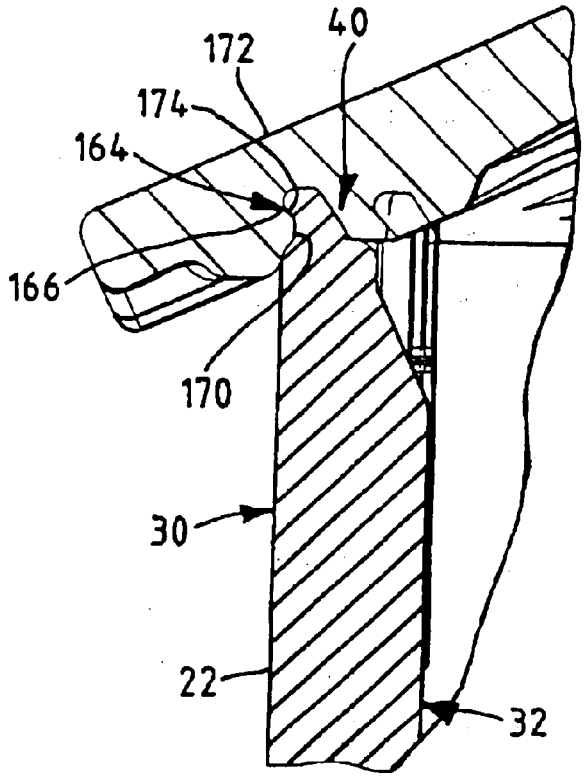
FIG. 15 is a fragmentary sectional view of the modular storage enclosure.
Figure 16:
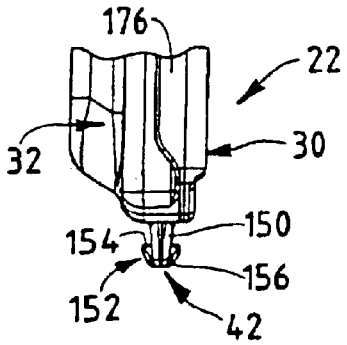
FIG. 16 is a fragmentary side elevational view of the panel of FIG. 2.
Figure 17:
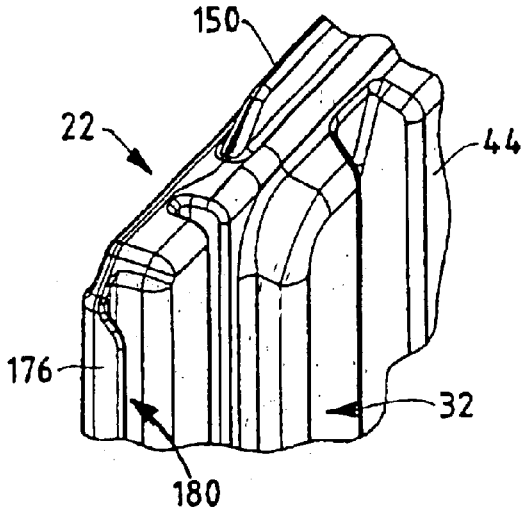
FIG. 17 is a fragmentary perspective view of the panel of FIG. 3.
Figure 18:
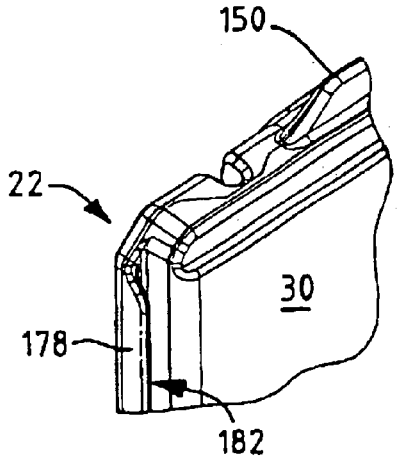
FIG. 18 is a fragmentary perspective view of the panel of FIG. 2.
Figure 19:
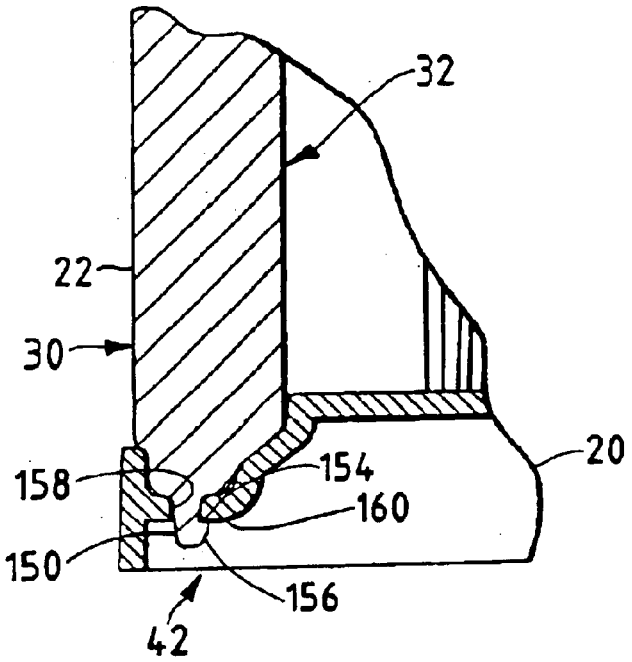
FIG. 19 is a fragmentary sectional view of the modular storage enclosure.
Figure 20:
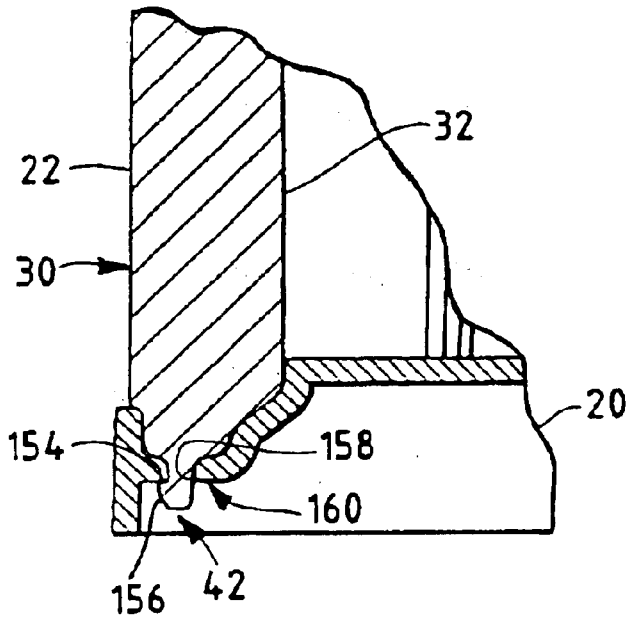
FIG. 20 is a fragmentary sectional view of the modular storage enclosure.

Referring to FIGS. 1, 14, and 15, roof assembly 18 includes a plurality of roof panels 172 coupled to side panels 22 and a pair of gables 184. Adjacent roof panels 172 are coupled by a plurality of roof connectors 186 which engage connector interfaces (not shown) on roof panels 172. Roof panels 172 include one or more channels 188, which are configured to provide drainage and additional rigidity. According to a preferred embodiment, roof assembly 18 is configured as a pitch or angled roof, and includes a ridge beam 190 that couples opposing roof panels 172. According to alternative embodiments, roof assembly 18 may have any of a variety of shapes and configurations configured to provide a cover to enclosure 10.

Referring to FIGS. 1, 6, and 20–22, roof assembly 18 includes plurality of roof panels 172 coupled to side panels 22 and a pair of gables 184. Adjacent roof panels 172 are coupled by a plurality of roof connectors 186 which engage connector interfaces (not shown) on roof panels 172. Roof panels 172 include one or more channels 188, which are configured to provide drainage and additional rigidity. According to a preferred embodiment, roof assembly 18 is configured as a pitched or angled roof, and includes a ridge beam 190 that couples opposing roof panels 172. According to alternative embodiments, roof assembly 18 may have any of a variety of shapes and configurations configured to provide a cover to enclosure 10.

Gables 184 include a ridge beam interface 192 and panel interfaces 194. Ridge beam interface 192 includes a plurality of ribs or flanges 196 configured to engage the profile of ridge beam 190. Preferably, ridge beam interface 192 includes a surface 198 configured to support ridge beam 190 and thus a portion of the weight of roof assembly 18. During assembly, roof panels 172 engage ridge beam 190 at an approximately horizontal orientation, and are then rotated approximately 25° to interlock protrusions on roof panels 172 to ridge beam 190 to capture ridge beam interface 192 on gables 184. Panel interface 194 includes a member 200. Member 200 extends downwardly from gable 184 and includes projections 204 (i.e., similar to the "T"-shaped projections shown on connector 128 in FIG. 20) configured to engage slots 202 on rear panel 24 or front panel 26. During assembly, projections 204 engage slots 202 (e.g., dovetail cavities or the like). Gable 184 may also have a plurality of ribs or fins 206 configured to provide additional strength and rigidity.

It is also important to note that the construction and arrangement of the elements of the modular storage enclosure as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the mounting interfaces for accessories may be used in a panel that is mounted on a wall (e.g., near a workbench, in an office environment, at a work site, in other industrial or institutional environments). Also, a panel with the mounting interfaces may be used individually as a separate, stand alone structure. Further, it is important to note that the terms "storage enclosure," "interface," and "accessories," are intended to be broad terms and not terms of limitation. The interfaces and connectors may be used with any of a variety of products or arrangements and are not intended to be limited to use with storage enclosures or sheds, but are intended to be used with any arrangement where modular, selective, or custom configuration or coupling is employed. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A storage enclosure comprising:

a floor, a roof, and a wall assembly defining an interior space;

the floor including at least one floor panel having an edge, wherein the at least one floor panel includes an aperture near the edge having a substantially continuous three dimensional profile extending across substantially all of the edge, and wherein the aperture provides a bottom surface;

the roof including at least one roof panel; and, the wall assembly comprising a plurality of wall panels, the wall panels having a top edge, a bottom edge, and a floor interface having a substantially continuous three dimensional profile extending across substantially all of the bottom edge, such that said floor interface is complementary to the aperture for coupling the wall panel to the aperture, wherein the floor interface comprises a flange extending past the bottom edge of the wall panel, the flange including a detent comprising a first ramped surface and a first catch surface for engaging the bottom surface of the floor panel.

2. The storage enclosure of claim 1, wherein the floor interface is integrally formed with the wall panel.

3. The storage enclosure of claim 1, wherein at least one of the wall panels has an interior panel face and an exterior panel face, and includes at least one channel disposed on the exterior panel face.

4. The storage enclosure of claim 1, wherein at least one of the wall panels includes a tack off.

5. The storage enclosure of claim 1, wherein at least one of the wall panels includes a panel interface configured to provide a retaining profile for receiving a connector for coupling adjacent wall panels.

6. The storage enclosure of claim 5, wherein the panel interface includes a recess and a pair of flanges that define a slot and a receptacle, further wherein the recess is disposed above the flanges.

7. The storage enclosure of claim 1, wherein at least one of the wall panels includes a mounting interface configured to provide a retaining profile for receiving an accessory.

8. The storage enclosure of claim 7, wherein the mounting interface includes a pair of opposing flanges that define a slot and a receptacle.

9. The storage enclosure of claim 8, wherein the slot has a top portion and a bottom portion, said slot being wider at the top portion than the bottom portion.

10. The storage enclosure of claim 1, wherein at least one wall panel includes a roof interface for coupling to the at least one roof panel.

11. The storage enclosure of claim 10, wherein the roof interface comprises a fin extending above the top edge of the at least one wall panel, the fin including a second ramped surface and a second catch surface.

12. The storage enclosure of claim 1, wherein the floor assembly includes at least two floor panels having interlocking teeth for coupling.

13. The storage enclosure of claim 1, wherein the wall panels are formed of blow molded plastic.

14. The storage enclosure of claim 13, wherein the plastic comprises high density polyethylene.

15. A storage enclosure comprising:

a floor, a roof, and a wall assembly defining an interior space;

the floor including at least one floor panel, wherein the at least one floor panel includes a first aperture having a first bottom surface;

the roof including at least one roof panel having an edge, wherein the at least one roof panel includes a second aperture near the edge having a substantially continuous three dimensional profile extending across substantially all of the edge, and wherein the second aperture provides a second bottom surface; and, the wall comprising a plurality of wall panels including at least one side panel, at least one rear panel, and at least one door panel, wherein the at least one side panel has a top edge, a bottom edge, a floor interface for coupling to the first aperture of the at least one floor panel, and a roof interface having a substantially continuous three dimensional profile extending across substantially all of the top edge, such that said roof interface is complementary to the second aperture for coupling the roof panel to the second aperture, wherein the roof interface comprises a fin extending past the top edge, the fin including a detent comprising a first ramped surface and a first catch surface for engaging the second bottom surface.

16. The storage enclosure of claim 15, wherein the floor interface and the roof interface are integrally formed with the side panel.

17. The storage enclosure of claim 15, wherein at least one of the wall panels includes a panel interface configured to provide a retaining profile for receiving a connector for coupling adjacent wall panels.

18. The storage enclosure of claim 15, wherein the panel interface includes a recess and a pair of flanges that define a slot and a receptacle, further wherein the recess is disposed above the flanges.

19. The storage enclosure of claim 15, wherein at least one of the wall panels includes a mounting interface configured to provide a retaining profile for receiving an accessory.

20. The storage enclosure of claim 19, wherein the mounting interface includes a pair of opposing flanges that define a slot and a receptacle.

21. The storage enclosure of claim 20, wherein the slot has a top portion and a bottom portion, said slot being wider at the top portion than the bottom portion.

22. The storage enclosure of claim 15, wherein the floor interface comprises a flange extending past the bottom edge of the side panel, said flange including a detent comprising a second ramped surface and a second catch surface for engaging the first bottom surface.

23. The storage enclosure of claim 15, wherein the floor assembly includes at least two floor panels having interlocking teeth for coupling.

24. The storage enclosure of claim 15, wherein the wall panels are formed of blow molded plastic.

25. A storage enclosure comprising:

a floor, a roof, and a wall assembly defining an interior space;

the floor including a blow molded thermoplastic floor panel, wherein the blow molded thermoplastic floor panel includes a first aperture having a first bottom surface;

a roof including a blow molded thermoplastic roof panel, wherein the roof panel includes a second aperture having a second bottom surface; and, a wall assembly including a plurality of blow molded thermoplastic wall panels having a top edge and a bottom edge, wherein at least one of said plurality of blow molded thermoplastic panels has a floor interface having a substantially continuous three dimensional profile extending across substantially all of the bottom edge for coupling to the first aperture in a snap-fit arrangement and a roof interface having a substantially continuous three dimensional profile extending across substantially all of the top edge for coupling to the second aperture in a snap-fit arrangement.

26. The storage enclosure of claim 25, wherein the floor interface comprises a flange extending past the bottom edge, said flange including a detent comprising a first ramped surface for insertion into the first aperture and a first catch surface for engaging the first bottom surface.

27. The storage enclosure of claim 26, wherein the roof interface comprises a fin that extends past the top edge and includes a detent comprising a second ramped surface for insertion into the second aperture and a second catch surface for engaging the second bottom surface.

* * * * *